US005429046A

United States Patent [19]

Shiba et al.

[11] Patent Number: 5,429,046

[45] Date of Patent: Jul. 4, 1995

[54] DAMPENING ROLLER AND METHOD FOR PRODUCING THE SAME AND DAMPENING SYSTEMS FOR A PRINTING APPARATUS EMPLOYING THE DAMPENING ROLLER

[75] Inventors: Noriyuki Shiba; Yuichi Okamura; Kohmei Kawahara, all of Tokyo, Japan

[73] Assignee: Kabushikigaisha Tokyo Kikai Seisakusho, Tokyo, Japan

[21] Appl. No.: 28,116

[22] Filed: Mar. 9, 1993

Related U.S. Application Data

[63] Continuation of Ser. No. 698,177, May 6, 1991, which is a continuation of Ser. No. 441,779, Nov. 27, 1989, abandoned..

[30] Foreign Application Priority Data

Nov. 28, 1988 [JP] Japan ..... 63-299944

[51] Int. Cl.[6] ..... B41L 23/18; B41L 25/18

[52] U.S. Cl. ..... 101/148; 101/350; 101/349

[58] Field of Search ..... 101/348, 349, 350, 147, 101/148; 29/121.1, 121.8, 132, 895, 895.3, 895.32

[56] References Cited

U.S. PATENT DOCUMENTS

| | | | |
|---|---|---|---|
| 2,804,678 | 9/1957 | Rockoff | 29/121 |
| 3,835,597 | 9/1974 | Wasil | 101/348 |
| 4,301,730 | 11/1981 | Heurich et al. | 101/348 |
| 4,567,827 | 2/1986 | Fadner | 101/350 |
| 4,860,652 | 8/1989 | Kawata | 101/348 |

FOREIGN PATENT DOCUMENTS

| | | | |
|---|---|---|---|
| 3445906 | 6/1986 | Germany . | |
| 0114852 | 6/1986 | Japan | 29/132 |

*Primary Examiner*—Edgar S. Burr
*Assistant Examiner*—Lynn D. Hendrickson
*Attorney, Agent, or Firm*—Foley & Lardner

[57] ABSTRACT

A dampening system for a printing apparatus includes a print plate, a printing cylinder contacting the print plate and adapted to supply water to the print plate, a feed device for feeding water to the printing cylinder, and a dampening roller adapted to transfer water from the feed means to the printing cylinder. The dampening roller comprises a roller having a dampening layer composed of a substrate through which is dispersed a plurality of minute hollow bodies. A plurality of the hollow bodies open towards the circumferential surface to form cells for transferring the water from the feed means to the printing cylinder. At least one of the size and the concentration of the hollow bodies dispersed within the substrate is selected depending on the amount of dampening water to be fed to the print plate.

18 Claims, 5 Drawing Sheets

DAMPENING ROLLER AND METHOD FOR PRODUCING THE SAME AND DAMPENING SYSTEMS FOR A PRINTING APPARATUS EMPLOYING THE DAMPENING ROLLER

This application is a continuation of application Ser. No. 07/698,177, filed May 6, 1991, which is a continuation of application Ser. No. 07/441,779, filed on Nov. 27, 1989 (Abandoned).

BACKGROUND OF THE INVENTION

1. Field of the Invention

The present invention relates to a dampening roller and a method for producing the dampening roller. Further, the present invention relates to dampening systems, employing the dampening roller, for a printing apparatus, particularly for an offset printing apparatus.

2. Description of the Prior Art

Conventionally, various dampening systems have been well known, for example "Insatu-Kogaku Binran (Printing Engineering Handbook)" published by Gihoudo Publishing Co., Ltd. dated on May 1, 1983, the first edition and the first issue, referring to from page 694, line 13 to page 695, line 7 and FIGS. 3, 4 and 17 on page 694; and "Offset Printing Apparatus" published by Nippon Printing Newspaper Company dated on Jun. 25, 1984, the first issue, referring to page 116 to page 121.

These conventional documents disclose dampening systems comprising a dampening form roller adjacent to a plate cylinder, a metal roller arranged at the upstream side with respect to the dampening form roller and in contact with it, and a dampening water feeding means such as a combination of a fountain pan and a fountain roller arranged at the upstream side with respect to the metal roller to feed the dampening water onto the metal roller. The dampening form roller is covered with a molleton or a dampening sleeve, or its surface is made of one of various hydrophilic rubber materials to make the dampening water be in an uniform water layer on the plate cylinder surface. The metal roller is provided with a hydrophilic chromium plated layer to allow the dampening water to spread more widely. The metal roller is driven to reciprocally move in the axial direction of the metal roller while the whole printing apparatus is working. The feeding amount of the dampening water to the plate cylinder is controlled by the cooperation between the metal roller and the dampening water feeding means; for example, by adjusting the contact pressure of the fountain roller in the fountain pan with the metal roller, adjusting the contact angle between the fountain roller and the metal roller, adjusting the revolving speed of the fountain roller, or adjusting the opening degree of a feeding nozzle of the water feeding means which is isolated from the metal roller. However, these dampening water feeding mechanisms are somewhat roughly adjusted in comparison with ink feeding mechanisms for feeding ink onto the plate cylinder.

Another type dampening water feeding apparatus was proposed by Japanese Patent Application Laid-Open Publication No. 63-91247 titled "Dampening Water Apparatus". This apparatus comprises a dampening water feeding means including a dampening water fountain, a fountain roller, and a doctor roller; a vibrator roller arranged at the upstream side of the fountain roller; a dampening roller arranged in contact with the vibrator roller and a circumferential surface of a plate cylinder; and a metering-cum-reserving roller which is in contact with the vibrator roller and isolated from the plate cylinder. The doctor roller is swingingly moved between the fountain roller and the vibrator roller to feed the dampening water from the fountain roller to the vibrator roller. Every rubber-made surface of the doctor roller, the dampening roller and the metering-cum-reserving roller is roughed by abrasion with an abrading wheel, laser-engraving or stamping. These roughed surfaces ensure the formation of an uniform water layer on the plate cylinder so as to produce prints with a high quality that are free from ghost and fuzz caused by dampening water, and further to reduce time for washing on changing color.

The dampening systems disclosed in the former conventional documents "Insatsu-Kogaku Binran" and "Offset Printing Apparatus" hereinafter referred to as "the former conventional devices" need some requirements to apply the dampening water in an uniform water layer onto the plate cylinder. That is, the chromium plated metal roller should be interposed between the dampening form roller and the dampening water feeding means, and reciprocatingly moved in its axial direction, and the dampening form roller should be covered with a molleton or a dampening sleeve, or the circumferential surface of the dampening form roller should be made of a hydrophilic rubber. However, even if the above requirements are wholly satisfied, the dampening water fed on the plate cylinder is not always formed in an uniform layer. Further, the driving mechanism for reciprocatingly moving the metal roller in its axial direction needs complicated maintenance works, the molleton or the dampening sleeve should be sometimes washed and replaced. As disclosed above, the former conventional devices need some complicated operations which will increase time and cost for operating such apparatus.

On the other hand, another type dampening water feeding apparatus disclosed in Japanese Patent Application Laid-Open Publication No. 63-91247, referred as the later conventional device, employs the dampening form roller provided with a roughed surface to remove the molleton or the dampening sleeve from the dampening form roller, thereby improving the defects caused by the former conventional devices. The later conventional device can also form an essentially uniform water layer on the plate cylinder as well as the former conventional devices. Further the later conventional device includes the metering-cum-reserving roller with the rough surface in addition to the doctor roller which is also provided with the rough surface. This arrangement allows the vibrator roller interposed between the dampening form roller and the doctor roller to be free from the requirement that the vibrator roller is reciprocatingly moved in its axial direction; there is no disclosure on this reciprocating motion in the Publication. Thus, the later conventional device can be free from problems caused by the preciprocating driving mechanism in the former conventional devices. On the contrary, the later conventional device requires the dampening roller, the doctor roller and the metering-cum-reserving roller to keep always predetermined rough condition to perform its purpose. The operator should always watch the abrasion in their roller surfaces while the printing apparatus is operating, and further should often replace the rollers and reproduce the rough surface.

BRIEF SUMMARY OF THE INVENTION

It is therefore an object of the present invention to provide a dampening roller which can feed certainly and uniformly a dampening water onto a plate cylinder.

Another object of the present invention is to provide a dampening roller which is free from abrasion by a dampening water removing means.

A further object of the present invention is to provide a dampening system for a printing apparatus to produce prints with superior quality.

A still further object of the present invention is to provide a method for producing the above described dampening roller.

To accomplish these objects, one aspect of the dampening roller according to the present invention comprises a support member formed in a cylindrical shape, and a dampening layer covering over the support member, which is composed of fine spheres or a mixture of fine hollow spheres and hard material powder. The spheres disposed in the circumferential surface of the dampening layer are ruptured to open the hollow interiors of the spheres. The spheres are mixed in the dampening layer at a mixing ratio depending on the feeding amount of the dampening water.

According to another aspect of the present invention, a method for producing the above described dampening roller comprises a first step for mixing the fine hollow spheres into the dampening layer, a second step for covering the support member with the dampening layer, and a third step for abrading the circumferential surface of the dampening layer to rupture a part of shell of each the spheres disposed in the surface.

The above described dampening roller does not require the molleton and the dampening sleeve, required in the conventional dampening rollers, and the driving mechanism for reciprocatingly moving the metal roller. The above described dampening roller is provided with the dampening layer possessed of metering and water-receiving function owing to the ruptured fine spheres dispersed in the circumferential surface of the dampening layer. A dampening system, employing the above described dampening roller, assembled on a printing apparatus ensures an uniform water layer onto the plate cylinder. This dampening system provides many advantages that the complicated works such as watching, cleaning, and exchanging the molleton or the dampening sleeve, and the maintenance for the reciprocating motion mechanism are completely eliminated.

The dampening layer of the above described dampening roller can always keep the metering and water-receiving function because the fine spheres will be gradually ruptured by further abrasion. Therefore, this dampening roller can be used for a long period in comparison with the conventional rollers. The above described advantages ensure to produce prints with a high quality and at a high operation efficiency without increasing cost.

Other objects and advantages of the present invention will become apparent during the following discussion of the accompanying drawings.

DETAILED DESCRIPTION OF THE PREFERRED EMBODIMENT

One preferred embodiment of a dampening roller and various embodiments of dampening systems according to the present invention will be discussed in conjunction with the drawings. Through the drawings the same numerals denote the same parts or corresponding elements, so that the same explanation will not be repeated.

Figure 1:
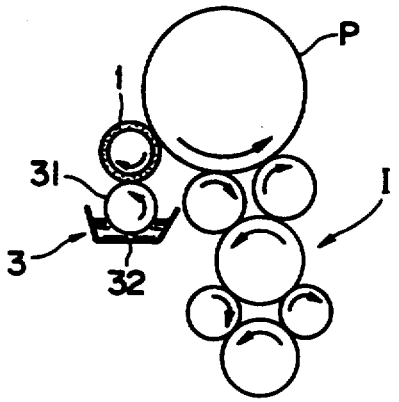
FIG. 1 is a schematic illustration showing one embodiment of a dampening system for a printing apparatus employing the dampening roller according to the present invention.

FIG. 1 shows an overall view of one embodiment of a dampening system adapted for a printing apparatus. In FIG. 1, the reference numeral 1 denotes a dampening roller whose circumferential surface is contact with a printing plate set on a plate cylinder P. At the upstream side of the dampening roller 1, a dampening water feeding means 3 is arranged to feed dampening water onto the circumferential surface of the dampening roller 1. The dampening roller 1 and the dampening water feeding means 3 cooperate to perform the dampening function.

Figure 2:
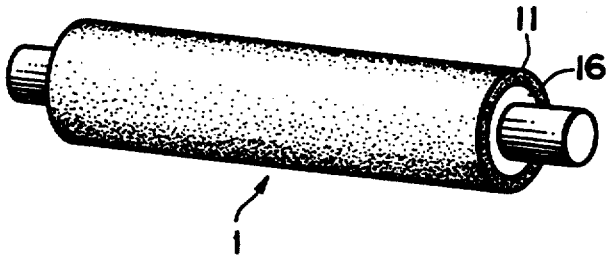
FIG. 2 is a schematic illustration showing an overall view of the dampening roller according to the present invention.
Figure 3:
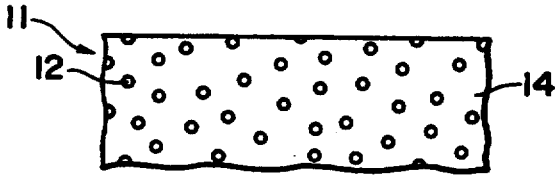
FIG. 3 and 4 are enlarged views showing the surface of the dampening roller shown in FIG. 2.
Figure 4:
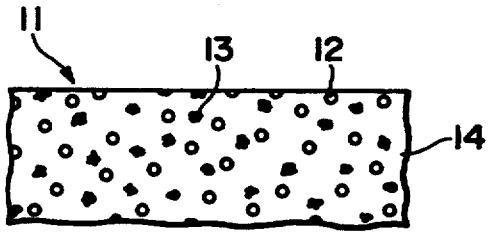

The dampening roller 1 is clearly shown in FIG. 2, in which the reference numeral 11 denotes a dampening layer covered on a cylindrical support member 16 made of steel, as an example. As shown in FIG. 3, the dampening layer 11 comprises a substrate 14 and a plurality of fine hollow spheres 12 uniformly dispersed in the substrate 14. Alternatively, the dampening layer 11 further includes a hard material powder 13 such as a hard inorganic powder in addition to the substrate 14 and the fine hollow spheres 12 as shown in FIG. 4.

The substrate 14 is made of a flexible material such as synthetic resins, natural resins, rubbers or the like. In this embodiment, the substrate 14 is made of an urethane resin. Particularly, a hydrophilic synthetic resin such as NBR/PVA co-cured mixture is preferably used.

The fine hollow sphere 12 to be uniformly dispersed in the substrate 14 will be formed with an opening by removing a part of its outer shell. The fine hollow spheres 12 have been well known as various names of micro-balloon, micro-sphere, hollow balloon, and syntactic foam. For example, carbon balloon, glass balloon, silica balloon, silas balloon, phenol balloon, vinylidene chloride balloon, alumina balloon, and zirconia balloon have broadly used as the fine hollow spheres. Typically, as commercial products "Carbo Spheres" (trade name) manufactured by VERSA Manufacturing Inc. in U.S.A. and "Fillite" (trade name) manufactured by Fillite Co.,. Ltd. in England have been commonly known. The former belongs to a carbon balloon and has a volume density of 0.15 g/cm$^3$ and their shell thickness is from 1 to 2 μm. The company has supplied four types depending on particle size. The first type has particle diameter range from 50 to 150 μm (average particle diameter; 50 μm), the second type has particle diameter range from 5 to 100 μm (average particle diameter; 45 μm), the third type has particle diameter range from 5 to 50 μm (average particle diameter; 30 μm), and the fourth type has particle diameter range from 50 to 150 μm (average particle diameter; 60 μm). Further, these particles may be coated with various metals such as nickle, iron, copper, gold or the like. Such metal coated particles are also effectively used.

"Fillite" belongs to a silica balloon and has a volume density of 0.4 g/cm$^3$ and a particle diameter range of 30 to 300 μm.

The fine hollow spheres 12 of this invention are preferably selected from the particle diameter range of 5 to 300 μm.

Various dampening rollers with various feeding amount can be easily produced by changing the mixing ratio of the fine hollow spheres 12 dispersed into the substrate 14, and/or by changing the particle size of the fine hollow spheres 12. Spot-printed sections and multicolor printed sections require fine adjustments for feeding the amount of the dampening water onto the plate cylinder in comparison with monocolor printed sections. In such spot-printed sections and multicolor printed sections the water feeding amount depends on the ratio between image zone and non-image zone.

The hard material powder 13 is preferably selected from ceramics powder, metal powder, alloy powder, or the like. In the present invention the hard material powder 13 with a particle diameter range of 1 to 100 μm can be used.

Next, a method for producing the above constituted dampening roller 1 will be described.

The dampening roller 1 shown in FIG. 3 is produced by a first process comprising a first step for uniformly dispersing the fine hollow spheres 12 in the substrate 14, a second step for covering the substrate 14 on the surface of the cylindrical support member 16 to form the dampening layer 11, and a third step for grinding the surface of the dampening layer 11. The fine hollow spheres 12 dispersed in the surface region are subjected to the grinding function and thus their shells are partially ruptured. The hollow interior of the fine hollow spheres 12 are partially opened. The dampening roller 1 shown in FIG. 4 is also produced by the above process except for the first step wherein the hard material powder 13 and the fine hollow spherers 12 are uniformly dispersed in the substrate 14. The fine hollow spheres 12 and the hard material powder 13 dispersed in the surface region are also subjected to the grinding function. Thus, the hollow interior of the fine hollow spheres 12 and the hard material powders 13 appeared in the surface of the dampening roller 1.

In the above described method, at the first step the fine hollow spheres 12 (and the hard material powder 13) are uniformly dispersed in the substrate 14 by well known mixing or kneading means in response to the properties and shape of the substrate 14. At the second step, the substrate 14 dispersed with the fine hollow spheres 12 (and the hard material powder 13) is coated on the surface of the cylindrical support member 16 a by well known casting, winding, or coating manner. At the third step, the surface of the dampening layer 11 is grinded by a grinding,machine or subjected to the grinding function by any suitable blade or bar after the dampening roller 1 has been assembled on a printing apparatus. By this grinding step, each shell of the fine hollow spheres 12 dispersed in the surface region of the dampening layer 11 is partially ruptured and removed so that the hollow interior of each the fine hollow spheres 12 is opened in the surface of the dampening roller 1. Also, the hard material powder 13 dispersed in the surface region of the dampening layer 11 is exposed by this grinding step.

As shown in FIG. 1, the dampening water feeding means 3 is arranged at the upstream side of the dampening roller 1. The feeding means 3 comprises a fountain roller 31 capable of revolving in contact with the circumferential surface of the dampening roller 1, and a fountain pan 32 for reserving the dampening water in which a part of the fountain roller 31 is always immersed. The dampening water is supplementally fed into the fountain pan 32 by any suitable means not shown and is kept at a predetermined level by any suitable overflow pipe or valve not shown.

FIG. 5 to FIG. 27 show various dampening systems according to the present invention, which are different from the above described system shown in FIG. 1.

Figure 5:
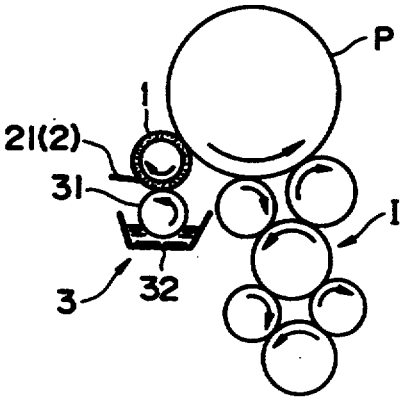
FIG. 5 to FIG. 7 are schematic illustrations showing various examples of dampening systems which are respectively provided with an ink removing means in addition to the system shown in FIG. 1.
Figure 6:
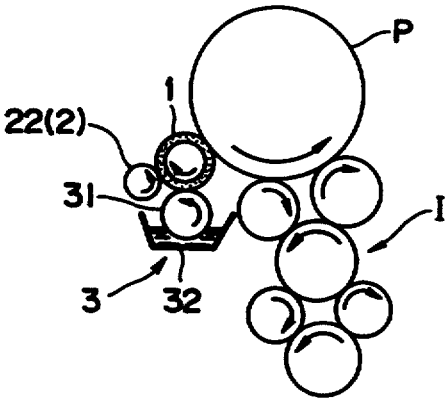
Figure 7:
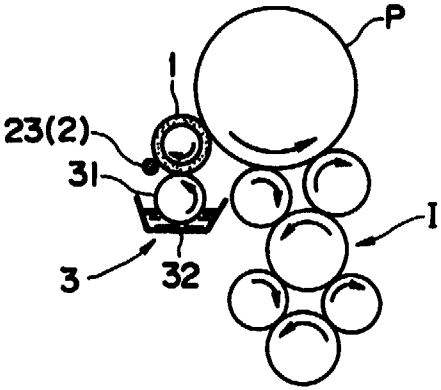

FIG. 5, FIG. 6 and FIG. 7 show modifications which are additionally provided with means 2 for removing excess water from the dampening roller 1. In FIG. 5, a blade 21, operable as the excess water removing means 2, is set in contact with the circumferential surface of the dampening roller 1. In FIG. 6, a supplemental roller 22, operable as the excess water removing means 2, is forcibly brought in contact with the circumferential surface of the dampening roller 1 so that the roller 22 can revolve at the substantially equivalent circumferential speed of the dampening roller 1. In FIG. 7, a bar 23 as the excess water removing means 2 is set in contact with the circumferential surface of the dampening roller 1.

As shown in FIG. 1, when any roller (the fountain roller 31 in this case) is set at the downstream side of the dampening water feeding means 3 and always in contact with the dampening roller 1 during a printing operation, the roller 31 is driven at the slower speed of the dampening roller 1, alternatively at the same speed with increasing the contact pressure between the roller 31 and the dampening roller 1 to act as the excess water removing means 2, particularly the roller 22 shown in FIG. 6.

FIG. 8 to FIG. 26 show various dampening systems 3 for feeding the dampening water to the dampening roller 1 and/or the plate cylinder P, which are various modifications of the system shown in FIG. 1; for example, these systems are not provided with the excess water removing means 2, but may be provided with any one of the blade 21, the roller 22, and the bar 23 as the excess water removing means 2 if possible.

Figure 8:
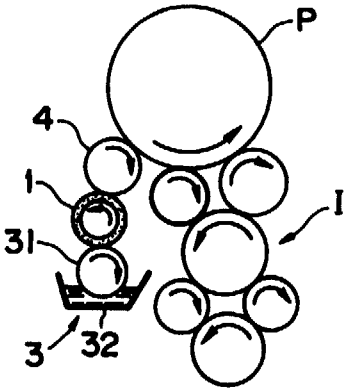
FIG. 8 to FIG. 27 are schematic illustrations showing other modified embodiments of dampening systems according to the present inventions.

The dampening system shown in FIG. 8 further includes a form roller 4 which is arranged at the downstream side of the dampening roller 1 and in contact with both of the dampening roller 1 and the plate cylinder P.

Figure 9:
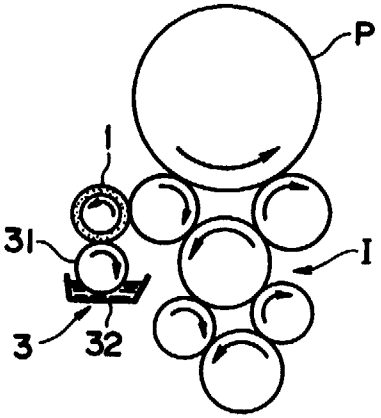

The dampening system shown in FIG. 9 employs the same dampening system shown in FIG. 1 whose dampening roller 1 is arranged in contact with the inking roller for feeding ink to the plate cylinder P.

Figure 10:
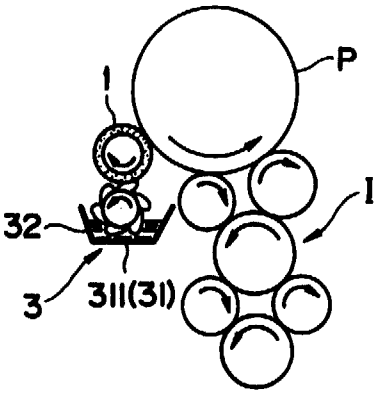

The dampening system shown in FIG. 10 employs a flap roller 311 instead of the fountain roller 31 used in the dampening system shown in FIG. 1.

The water feeding means 3 of the above described three systems shown in FIG. 8, FIG. 9 and FIG. 10 always require the dampening water reservoir 32 which is well known as a fountain pan or a water vessel.

Figure 11:
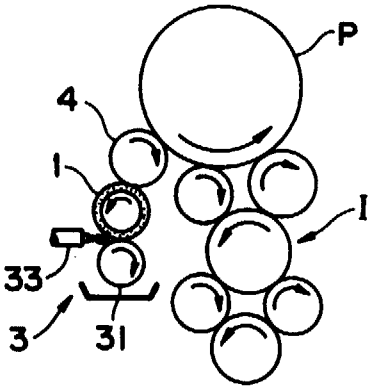
Figure 12:
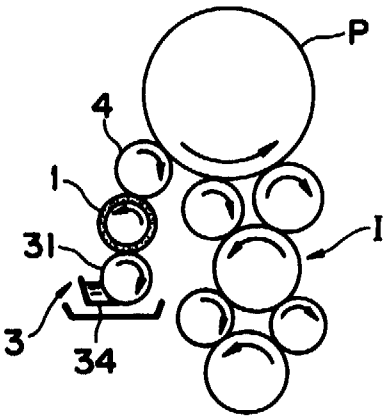
Figure 13:
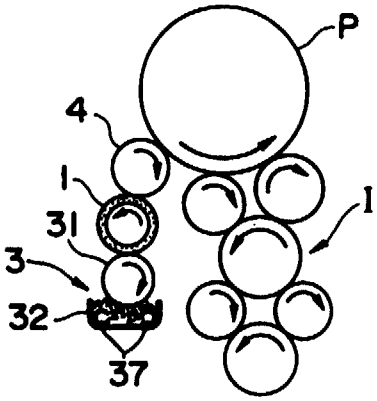

On the contrary, FIG. 11, FIG. 12 and FIG. 13 show the dampening systems which employ other means instead of the dampening water reservoir 32 of the above described systems.

The dampening system shown in FIG. 11 employs a water injection nozzle 33 such as a spray nozzle or a jet nozzle.

The dampening system shown in FIG. 12 employs a water supplier 34 whose one opening is in contact with the circumferential surface of the fountain roller 31.

The dampening system shown in FIG. 13 employs a water reservoir 32 with a stirring mechanism 37 for stirring the water reserved in the reservoir 32. This stirring mechanism 37 comprises an air pipe formed in the bottom of the reservoir. Through the air pipe compressed air is injected to stir the water in the reservoir. The stirring mechanism 37 is not limited to this structure, but any mechanisms to stir and to bring always the water into contact with the fountain roller 31 may be also employed.

Figure 14:
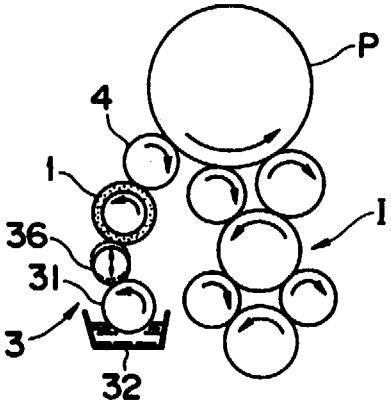

FIG. 14 shows a further modification of the dampening system shown in FIG. 8. The system shown in FIG. 14 is provided with a swinging roller 36 which is alternatively brought into contact with the fountain roller 31 and the dampening roller 1. Although FIG. 14 shows the reservoir 32 as the required component of the dampening water feeding means 3, the reservoir 32 may be replaced with any one of the water feeding members shown in FIG. 11, FIG. 12 and FIG. 13, or FIG. 21, FIG. 22, FIG. 23 and FIG. 24, described later. Alternatively, the swinging roller 36 may be always in contact with both the fountain roller 31 and the dampening roller 1.

FIG. 15 to FIG. 27 show various dampening systems without the fountain roller 31 of the dampening water feeding means 3.

Figure 15:
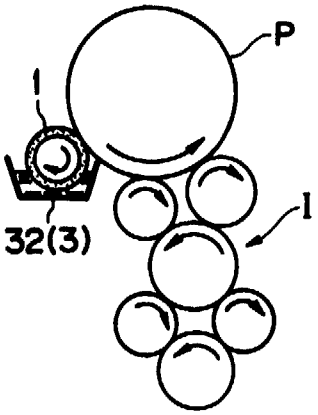

The dampening system shown in FIG. 15 corresponds to the modification with removing the fountain roller 31 from the system shown in FIG. 1 or FIG. 10. The dampening system shown in FIG. 16 corresponds to the modification with removing the fountain roller 31 or the swinging roller 36 from the system shown in FIG. 8 or FIG. 14. The dampening system shown in FIG. 17 corresponds to the modification with removing the fountain roller 31 from the system shown in FIG. 9. The dampening systems shown in FIG. 18, FIG. 19 and FIG. 20 respectively correspond to the modifications with removing the fountain roller 31 from the systems shown in FIG. 11, FIG. 12 and FIG. 13.

Figure 16:
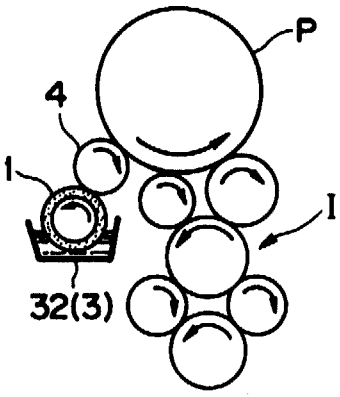
Figure 17:
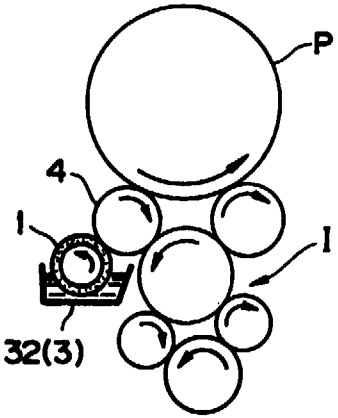
Figure 18:
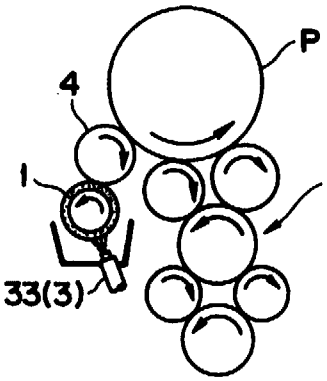
Figure 19:
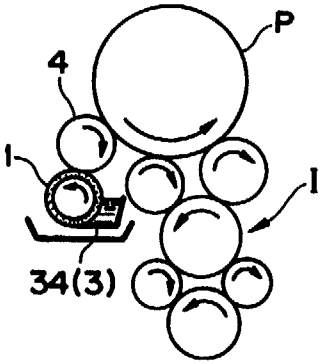
Figure 20:
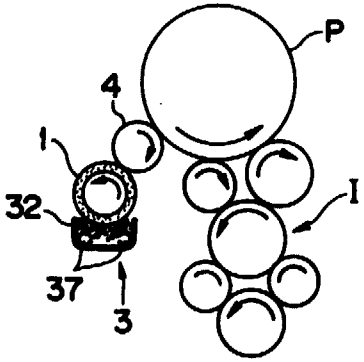

FIG. 21 to FIG. 27 show the modifications with another means replaced for the fountain pan 32 of the dampening water feeding means 3 shown in FIG. 16.

Figure 21:
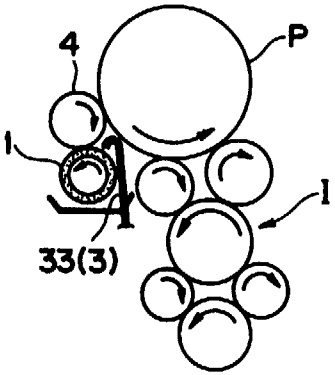

The dampening system shown in FIG. 21 employs a water feeding nozzle 33 instead of the fountain pan 32.

Figure 22:
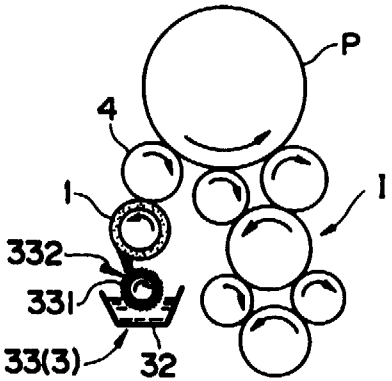

The dampening system shown in FIG. 22 employs a reservoir 32, a brush roller 331 a part of which is always immersed in the dampening water in the reservoir 32 and rotates with dipping out the dampening water, and a flicker blade 332 which is forcibly placed in contact with the brush roller 31 to bend its brush. The bent brush will discharge the dipped water as the brush returns from its bent position by the resiliant returning force of the brush roller.

Figure 23:
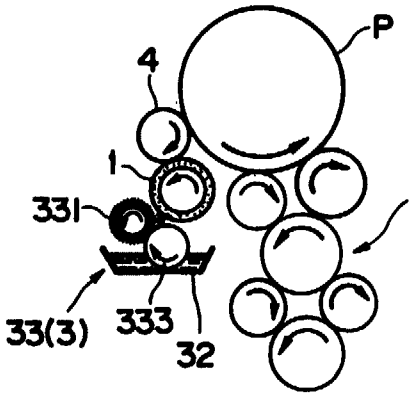

The dampening system shown in FIG. 23 employs a reservoir 32, a fountain roller 333 and a brush roller 331 a part of which is always immersed in the dampening water in the reservoir 32 and forcibly contact with the fountain roller 333. The brush roller 331 rotates with dipping out the dampening water so that the dipped water is discharged as the brush returns from its bent position by the resiliant returning force of the brush.

Figure 24:
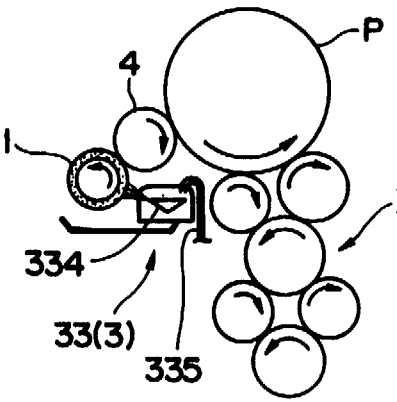

The dampening system shown in FIG. 24 employs a dish shape disk 334 and a water feeding nozzle 335 for feeding the water onto the disk 334. The water is discharged onto the dampening roller 1 owing to the centrifugal force generated by the rotation of the disk 334.

Figure 25:
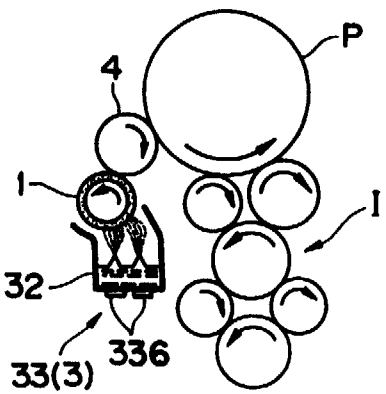

The dampening system shown in FIG. 25 employs a reservoir 32 and at least one supersonic vibrator 336 for generating a spray of water.

Figure 26:
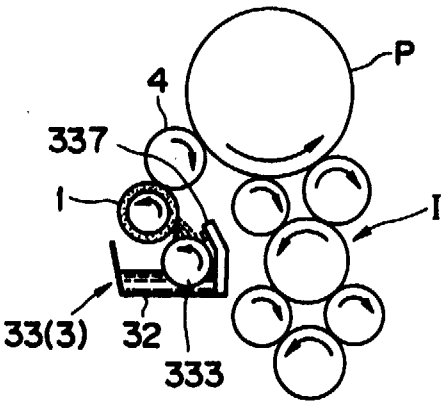

The dampening system shown in FIG. 26 employs a reservoir 32, a fountain roller 333 a part of which is always immersed in the dampening water in the reservoir 32, and an air nozzle 337 for injecting air to the circumferential surface of the fountain roller 333 so that the dampening water on the fountain roller 333 is sprayed by the injected air.

Figure 27:
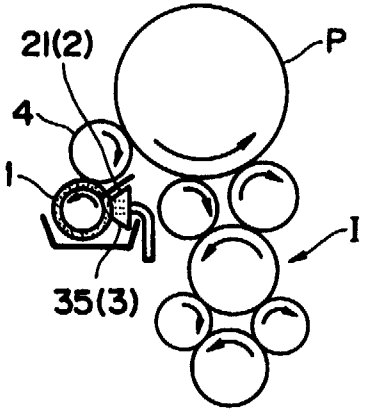

The dampening system shown in FIG. 27 employs a water supplier 35 whose opening is in contact with a part of the circumferential surface of the dampening roller 1. The water supplier 35 is further provided with an excess water removing means such as a blade 21.

In the above described systems, the reservoirs 32 are also provided with any means for keeping the level of the dampening water as same as the fountain pan 32. The dampening systems shown in FIG. 21 to FIG. 27 may be applied to the dampening roller 1 in the systems shown in FIG. 15 or FIG. 17 if possible. Also, the dampening systems shown in FIG. 21 to FIG. 27 may be provided with the fountain roller 31.

Dampening operations of the above described dampening systems will described in detail.

In general, the water is fed onto the circumferential surface of the dampening roller 1 through the dampening water feeding mens 3. In the systems with the fountain pan 32, the dampening roller 1 or the fountain roller 31 is partially dipped in the water reserved in the fountain pan 32. The water is directly fed to the circumferential surface of the dampening roller 1 from the fountain pan 32, or fed to the circumferential surface of the dampening roller 1 through the fountain roller 31 (and the another roller 36).

In the case that the dampening water feeding means 3 including the water injection nozzle 33, the nozzle 33 directly discharges the water onto the circumferential surface of the dampening roller 1, .or to the contact section between the fountain roller 31 and the dampening roller 1. In other systems, the nozzle 33 directly discharges the water onto the circumferential surface of the fountain roller 31 and then the water is fed to the circumferential surface of the dampening roller 1 or through the circumferential surface of another roller such as the swinging roller 36.

In the case that the water feeding means 3 includes the water supplier 34 or 35 whose opening is in contact with a part of the circumferential surface of the dampening roller 1 or the fountain roller 31, the dampening water is directly fed onto the circumferential surface of the dampening roller 1 from the supplier 34 or 35, or fed onto it through the circumferential surface of the fountain roller 31 from the supplier 34.

In the case that the water feeding means 3 includes the water reservoir 32 oppositely isolated from the dampening roller 1 and the stirring mechanism 37 for stirring the water reserved in the reservoir 32, the stirring mechanism 37 makes waves in the water so that the waved water can directly reach to the circumferential surface of the dampening roller 1 or supply the water to the dampening roller 1 through the fountain roller 31.

The dampening water fed onto the dampening roller 1 is partially introduced into the hollow interior of the fine hollow spheres 12 dispersed in the surface region of the dampening roller 1 and the excess water remaining on the surface is removed therefrom. The water held in the circumferential surface of the dampening roller 1 is directly fed onto the print plate set on the plate cylinder P or fed through the form roller 4 or the inking roller of the inking system I.

The revolving speed of the dampening roller 1 depends on the printing speed of the plate cylinder P. Under the high speed printing condition, the excess water can not be sufficiently removed from the circumferential surface of the dampening roller 1 during each revolution. Thus, the dampening water will be fed onto the plate cylinder P in excess. To improve this problem, the excess water removing means 2 is set in contact with the circumferential surface of the dampening roller 1 to forcibly remove the excess water from the dampening roller 1. On the other hand, when the dampening roller 1 is in contact with the fountain roller 31 or another roller such as the swinging roller 36 of the dampening water feeding means 3, the excess water can be forcibly removed from the dampening roller 1 as well as by the supplemental roller 22 of the excess water removing means 2 by adjusting the contact pressure between the dampening roller 1 and the fountain roller 31 or the swinging roller 36, or making the revolving speed of the fountain roller 31 or the swinging roller 36 be slower than that of the dampening roller 1.

After this excess water removing function, the water is remained in the hollow interior of the fine hollow spheres 12 in the circumferential surface of the dampening roller 1. Such remained water is then directly fed onto the print plate set on the plate cylinder P or fed through the form roller 4 or the inking roller of the inking system I.

The excess water removing means 2 may be also applied to any printing machines operating at a slow printing speed.

The circumferential surface of the dampening roller 1 will be gradually abraded as the printing apparatus is operated for a long period. By the abrasion, the fine hollow spheres 12 are dispersed and ruptured to open their hollow interior. According to this effect, the dampening layer 11 can keep its optimum water receiving function until immediately before the dampening layer 11 is disappeared. Therefore this dampening roller ensures to feed the dampening water at a constant rate for an extremely long period.

In addition to the above effect, the dampening layer 11 including the hard material powder 13 can prolong the operation period of the dampening roller 1 because the hard material powder 13 mainly resists the abrading force by the excess water removing means 2. This case also can keep its optimum water receiving function until immediately before the dampening layer 11 is worn away. Therefore this dampening roller also ensures to feed the dampening water at a constant rate for an extremely long period.

As many apparently widely different embodiments of this invention may be made without departing from the spirit and scope thereof, it is to be understood that the invention is not limited to the specific embodiments thereof except as defined in the appended claims.

What is claimed is:

1. A dampening system for a printing apparatus comprising:

(A) a print plate;

(B) a printing cylinder contacting said print plate and adapted to supply water to said print plate;

(C) feed means for feeding water to said printing cylinder; and (D) a dampening roller adapted to transfer water from said feed means to said printing cylinder, said dampening roller comprising a roller having a dampening layer composed of a substrate, said substrate being substantially free of textile fibers, and a plurality of hollow bodies dispersed through said substrate, (E) means for abrading a circumferential surface of said substrate to open a plurality of said hollow bodies towards said circumferential surface to form cells for transferring said water from said feed means to said printing cylinder, and wherein at least one of the size and the concentration of said hollow bodies dispersed within said substrate is selected depending on the desired amount of dampening water to be fed to said print plate.

2. The system of claim 1, wherein said dampening layer further comprises a hard material uniformly dispersed in said substrate.

3. The system of claim 2, wherein the diameter of each of said hollow bodies is between 5 μm and 300 μm in diameter.

4. The system of claim 1, further comprising means, contacting a circumferential surface of said dampening roller, for removing excess water from said dampening roller, and wherein said circumferential surface of said dampening roller is abraded by said means for removing to open said plurality of hollow bodies.

5. The system of claim 4, wherein said means for removing comprises a blade.

6. The system of claim 1, wherein said feed means comprises a fountain pan filled with water.

7. The system of claim 6, wherein said feed means further comprises a fountain roller disposed between said fountain pan and said dampening roller and adapted to transfer water from said fountain pan to said dampening roller.

8. The system of claim 7, wherein said feed means further comprises a swinging roller disposed between said fountain roller and said dampening roller and adapted to transfer water from said fountain roller to said dampening roller.

9. The system of claim 7, wherein said feed means further comprises nozzle means for injecting air onto a circumferential surface of said fountain roller to spray water onto said dampening roller.

10. The system of claim 6, wherein said feed means further comprises a brush roller disposed between said fountain pan and said dampening roller and adapted to transfer water from said fountain pan to said dampening roller.

11. The system of claim 6, wherein said feed means further comprises a supersonic vibrator located within said fountain pan and adapted to spray water onto said dampening roller.

12. The system of claim 1, wherein said feed means comprises a water supplier with an opening in contact with said dampening roller.

13. The system of claim 1, wherein said feed means comprises a water reservoir having a stirring mechanism disposed therein for supplying water to said dampening roller.

14. The system of claim 1, wherein said feed means comprises a feed nozzle which is adapted to spray water onto said dampening roller.

15. The system of claim 1, wherein said feed means comprises a dish shaped disk disposed adjacent said dampening roller and a water feeding nozzle for feeding water onto said disk.

16. The system of claim 1, wherein said hollow bodies are uniformly dispersed within said substrate.

17. The system of claim 1, wherein said substrate is abradable during use to expose said hollow bodies.

18. The system of claim 2, wherein said hard material is a hard inorganic powder.

* * * * *